US006196863B1

(12) United States Patent
Schwant

(10) Patent No.: US 6,196,863 B1
(45) Date of Patent: Mar. 6, 2001

(54) ELECTRICAL CONNECTION ARRANGEMENT AND METHOD FOR MAKING ELECTRICAL CONNECTION

(75) Inventor: Wilfried Schwant, Meinersen (DE)

(73) Assignee: Volkswagen AG, Wolfsburg (DE)

( * ) Notice: Subject to any disclaimer, the term of this patent is extended or adjusted under 35 U.S.C. 154(b) by 0 days.

(21) Appl. No.: 09/518,228

(22) Filed: Mar. 2, 2000

Related U.S. Application Data

(63) Continuation of application No. PCT/EP98/04747, filed on Mar. 29, 1998.

(30) Foreign Application Priority Data

Sep. 20, 1997 (DE) ..... 197 41 603

(51) Int. Cl.[7] ..... H01R 4/24
(52) U.S. Cl. ..... 439/417; 439/936
(58) Field of Search ..... 439/417, 936, 439/404, 204, 521, 325

(56) References Cited

U.S. PATENT DOCUMENTS

| | | | |
|---|---|---|---|
| 4,318,580 | | 3/1982 | Fleisher et al. . |
| 4,954,098 | * | 9/1990 | Hollingsworth et al. ..... 439/404 |
| 5,561,269 | | 10/1996 | Robertson et al. . |

FOREIGN PATENT DOCUMENTS

| | | |
|---|---|---|
| 3030286 | 2/1982 | (DE) . |
| 3030236 | 3/1982 | (DE) . |
| 3543200 | 7/1986 | (DE) . |
| 9402621 | 5/1994 | (DE) . |
| 4305544 | 8/1994 | (DE) . |
| 4336849 | 1/1995 | (DE) . |
| 4427675 | 2/1995 | (DE) . |
| 0529957 | 3/1993 | (EP) . |
| 0631344 | 12/1994 | (EP) . |
| 0665608 | 8/1995 | (EP) . |
| 0731531 | 11/1996 | (EP) . |
| 1514423 | 6/1978 | (GB) . |
| 9601510 | 1/1996 | (WO) . |
| 9716869 | 5/1997 | (WO) . |

* cited by examiner

*Primary Examiner*—Lincoln Donovan
*Assistant Examiner*—Brian S. Webb
(74) *Attorney, Agent, or Firm*—Baker Botts L.L.P.

(57) ABSTRACT

The electrical connection arrangement disclosed in the specification has a housing with two housing parts into which a cable, such a multiconductor flat cable, can be positioned in an at least partially form-fitting manner, and a plurality of insulation piercing contact members which, when moved toward the cable, can displace the insulation of the cable, penetrating into the cable and establishing electrical contact with corresponding cable conductors. In order to provide safe and corrosion-resistant electrical contacts with ring circuits at any location along the ring circuit without cutting the circuit, the ring circuit cable is positioned between the cable piercing contact members and gel is forced from a gel reservoir to which pressure is applied into the openings in the cable insulation to surround the electrical connections with gel.

9 Claims, 2 Drawing Sheets

ELECTRICAL CONNECTION ARRANGEMENT AND METHOD FOR MAKING ELECTRICAL CONNECTION

REFERENCE TO RELATED APPLICATION

This application is a continuation of International Application No. PCT/EP98/04747 filed Jul. 29, 1998.

BACKGROUND OF THE INVENTION

This invention relates to electrical connection arrangements having a housing into which a cable can be received and one or more insulation-piercing electrical contacts are mounted to displace the cable insulation and establish electrical contact with a cable conductor and to a method for making electrical connection with a conductor in an insulated cable.

A variety of arrangements for making electric contact or connection with conductors in an insulated cable are known. Cables which are installed as internal bus cable systems in vehicles are being used to an ever-increasing extent, particularly in automobiles. In addition, it has been found expedient to use so-called ring circuits, which are installed in a vehicle when it is manufactured. The ring circuits are continuous circuits having, as a rule, no initial contact interfaces. This is because automobiles are ordered by customers with varied equipment rather than identical equipment and some electrical components are installed after they are ordered. As a result, the automobile equipment bus circuit is universally installed initially as a ring circuit. During manufacture of a vehicle more or fewer individually locatable electrical connection devices are required at suitable positions within the vehicle depending upon equipment features in order to connect, for example, electric window openers or other equipment-dependent electrical components directly, to the ring circuit. The provision of a ring circuit with direct electrical connection arrangements eliminates the need for cable harnesses, at least in certain sections within the vehicle. In addition, this procedure not only has manufacturing advantages, but advantages that appear in later use of the vehicle as well. For example, if in the later use of a vehicle a conventional cable harness having an electrical component breaks down, a large number of cables have to be found and followed in order to find a possible contact problem. In a bus ring circuit, only the contact element that connects to the particular defective component has to be found in order to be able to follow and possibly find a faulty mechanical contact or determine whether the component to which it is connected is defective.

The starting point in the use of such a bus ring circuit is the connection of the corresponding electrical component to the bus circuit, i.e., establishment of the contact.

In this connection, German Offenlegungsschrift No. 30 30 286 discloses an electrical connection plug in which a plurality of insulated wires are engaged by cutting elements. In this case, the cutting elements, which constitute electrical contacts, engage the wires in such a way that the insulation is pierced and the cutting elements either contact the conductors or, for better contact, possibly even cut partially into the conductors. Thus, the cutting elements form the electrical contacts that produce an electrical connection between the corresponding individual wire conductors and a cable connector or the like which is inserted into the plug.

When bus circuits are used in motor vehicles, they must also withstand rough everyday operation. This means exposure in some cases to varying thermal loads in a temperature range near the engine from about minus 40 degrees to up to 100 degrees Celsius, for example. It is known that, with varying temperature loading, environmental influences due to moisture or corrosive substances act especially rapidly and strongly affect the connection thus established by permanent corrosion. In automobile manufacture, however, it is required that secure connection under these environmental influences must be assured for at least 15 years.

Under these conditions, it is insufficient merely to enclose such a connection.

Other prior art, for example German Offenlegungsschrift No. 44 27 675, discloses an electrical connector which is sealed with a gel. In this arrangement, a cable end or a plug is introduced into a plug-in device and sealed with gel by a pressing or tamping device. The embodiment described in that document is disadvantageous because the device as a whole is complicated and is not useful for a ring circuit since it requires a separate electrical wiring arrangement consisting of two circuit sections which, moreover, provides for only one cable.

In addition, European Published Application No. 0 731 531 discloses an electrical connector in which a cable conductor mounted on a sleeve can be slipped onto a plug contact which receives the sleeve. That arrangement has a gel reservoir within the sleeve which is located so that, when the cable is inserted, the gel reservoir is first pierced and thereafter, i.e., when the cable is pushed in further, electrical contact is made with a contacting lug. Subsequently, pressure is exerted on the gel reservoir by a tamping device so that the gel is distributed within the plug. This is disadvantageous because, upon introduction of the cable, the gel reservoir is first pierced so that the cable conductor becomes coated with the gel and electrical contact is made only after the cable conductor has been coated, which may lead to a faulty connection. In this case, too, the device cannot be used for a connection of a ring circuit, since the wiring arrangement requires two separate circuit sections to be connected together.

SUMMARY OF THE INVENTION

Accordingly, it is an object of the present invention to provide an electrical connection arrangement and a method for making electrical connections which overcome disadvantages of the prior art.

Another object of the invention is to provide a reliable and corrosion-resistant electrical connection arrangement for ring circuits that may be located at any desired point of the ring circuit without interrupting the circuit.

These and other objects of the invention are attained by providing an electrical connection arrangement for a cable having a cable receiving portion conforming to the shape of a cable and at least one insulation-penetrating electrical contact member and a gel reservoir arranged in such a way that the cable is positioned between the gel reservoir and the insulation-penetrating electrical contact member so that the contact member penetrates the cable before penetrating the gel reservoir.

According to the invention, the method for making electrical connections involves three succeeding steps, namely:

1. establishment of electrical connection of the cutting contact member with the cable conductor;
2. concurrently with the establishment of an electrical connection, compressing a sealing gel reservoir; and
3. cutting into the gel reservoir after establishment of electrical connection so that gel passes to the electrical connection.

With respect to the connection arrangement, an important aspect of the invention is that, prior to making the connection, the cable is positioned between the cutting contact members and the gel reservoir. Consequently, when the cutting contact members are moved to penetrate the cable insulation, this relative positioning of the individual elements according to the invention causes the insulation of the cable to be cut first so that the cutting contact members then make contact with the cable conductors and then, only upon further motion, the cutting electrical contact members pierce the gel reservoir on the opposite side of the cable. Consequently, the sealing gel, on which pressure has already been exerted simultaneously with the cable piercing motion, is not released into the electrical connection region until after the electrical connection has already been made. Thus, the cutting contact members are absolutely clean when the electrical connections are established and the actual engaging electrical contact surfaces not coated with gel but are surrounded by the sealing gel. This produces exceptionally good electrical connection and, in addition, also provides precisely located sealing of the insulation where it has been pierced. Moreover, this connection arrangement has the important advantage that, with the specified relative locations of the cutting contact members, the conductors of the cable and the gel reservoir, a ring circuit can be contacted electrically and the contact points can also be sealed with gel. Thus, the bus circuit need not be interrupted, as would be the case with use of the prior art arrangements mentioned above.

In this respect, sealing as well as mounting of the electrical connection arrangement at any desired point on a ring circuit can be carried out according to the invention. In addition, it is also advantageous that, even when a particular electrical connection is damaged, a repair can be made simply by opening the connection and shifting the contact point a few millimeters or centimeters along the cable and then reengaging the connection arrangement with the cable. Then the old contact point is merely treated or closed off with a pasty sealing material.

In an advantageous embodiment of the invention, the connection housing consists of a lower housing part, which contains a gel reservoir, and an upper housing part, in which the cutting contact members are mounted. These two housing parts are movable with respect to each other, so that the electrical contacting and the gel release and sealing action can take place in a single actuating motion joining the two housing parts together. This is a distinct simplification with respect to other, conventional procedures. In this regard, it is additionally advantageous to provide a contoured surface or indentation in the cable engaging surface of the lower housing part so that the cable can be received in an at least partially form-fitting manner and therefore precisely positioned for suitable cutting contact by the contact members. With this arrangement, the cable is accurately located in a desired position so that the cutting members engage the corresponding cable conductors at the correct point and the cable cannot slip during the connection process.

In an additional advantageous embodiment of the invention, the upper and lower contacting housing parts are connected together by a hinge so that the actuating motion extends along an arcuate path. In this way, the provision of a connection arrangement having separable parts is eliminated. Such a hinge may for example be constituted by a so-called film hinge, which consists of a wedge-shaped thinned region extending between the upper and lower housing parts. In this way, it is possible to make the upper part and lower part of the housing in one piece, for example of synthetic material. The two-part nature and the guided motion of the upper and lower housing parts toward each other is further assured by the provision of a film hinge.

In an additional advantageous embodiment of the invention, piston and cylinder-like elements are formed on or in the upper and lower housing parts, respectively, so that the actuating motion applies pressure to the gel in the reservoir. Thus, compared with the above-described prior art, the additional advantage is produced that filling the connection region with gel need not be done in a separate operation, but can take place during the same actuating motion of the contact members, that is, during the motion of the two parts toward each other, and the upper and lower parts of the housing can then be clipped together in the closed position. In a further advantageous embodiment of the invention, gel flow channels are provided within the lower housing part as well as in the upper housing part so that, after cutting of the gel reservoir, gel fills the region around the electrical connection above as well as below the cable conductors and, particularly, at locations where the cutting members contact have passed through the cable insulation.

BRIEF DESCRIPTION OF THE DRAWINGS

Further objects and advantages of the invention will be apparent from a reading of the following description in conjunction with the accompanying drawings, in which.

DESCRIPTION OF PREFERRED EMBODIMENTS

Figure 1:
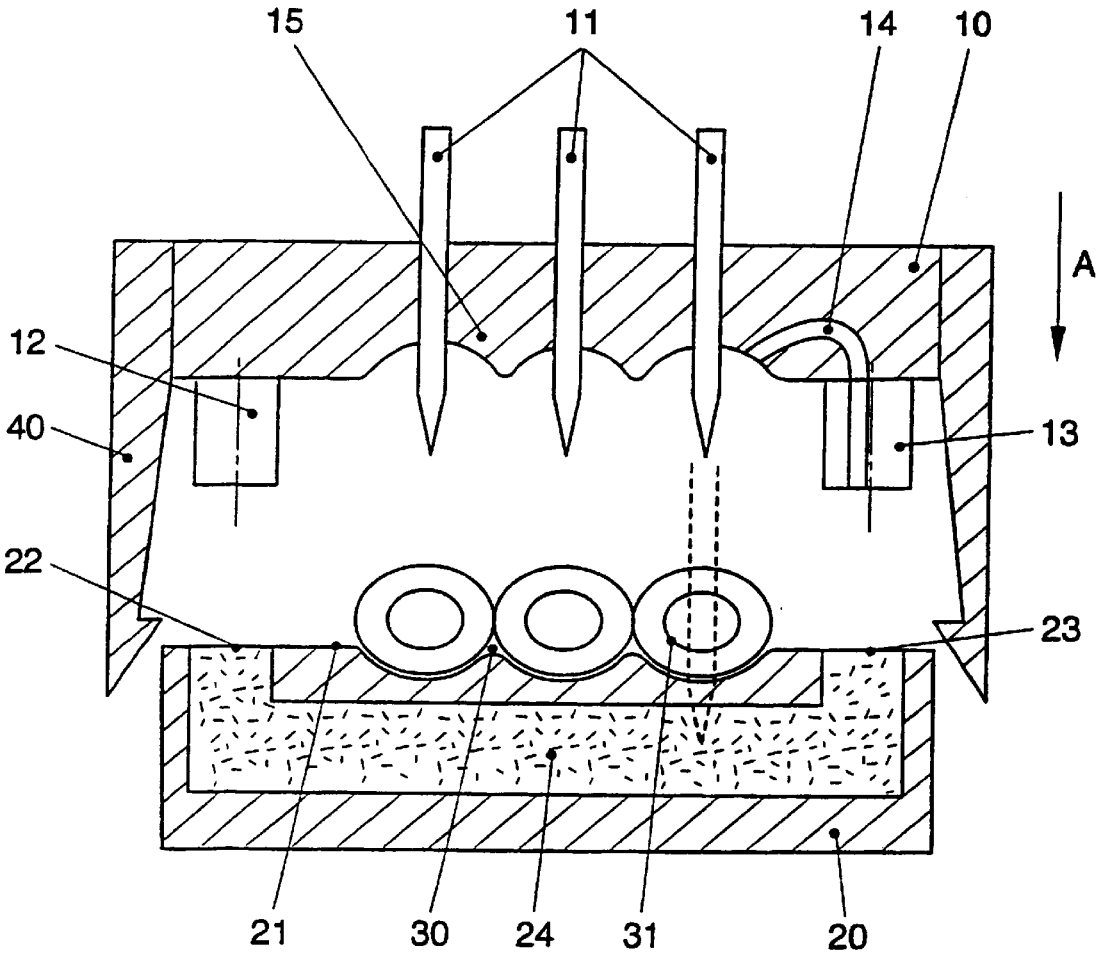
FIG. 1 is a cross-sectional view illustrating a representative embodiment of an electrical connection arrangement according to the invention with upper and lower housing parts separated.

The typical embodiment of the invention shown in FIG. 1 has an upper housing part 10 and a lower housing part 20 which are separate from each other. Three cutting contact members 11 are mounted in the upper housing part 10. These contact members have connecting pins on the outside of the housing for conductors leading to electrical equipment (not shown) which is to be connected to the cable. The lower ends of the cutting contact members 11 have sharp tips or edges by which the insulation of a cable 30 received in the housing is pierced. A gel reservoir 24 is provided in the lower housing part 20 below the cable 30. This arrangement of the parts according to the invention assures that, prior to closing of the housing parts, the cable is properly positioned between the cutting contact members 11 and the gel reservoir 24. The cable, which is illustrated as a multiconductor flat cable 30, engages a contoured surface 21 of the lower housing part 20. This contoured surface 21 provides a partial form-fit because it is complementary to the outer contour of the cable 30. The upper housing part 10 has a correspondingly contoured cable engaging surface 15.

The gel reservoir 24 is filled with a suitable scaling gel, for example silicone, or alternatively with a vulcanizing gel. This reservoir is sealed by covering membranes 22 and 23 until the electrical connection is made.

To produce an electrical connection, the cable 30 is set in the proper position between the two housing parts and the upper housing part 10 is moved toward the lower housing part 20 in the direction indicated by the arrow A in FIG. 1. The cutting contact members 11 then penetrate the insulation of the cable 30 and make electrical contact with the cable conductors 31. In this motion, the insulation is either pierced or slit so that electrical contact can be established with the conductors. Upon further motion in the direction of the arrow A, the cutting contact members 11 penetrate the cable completely without, however, cutting the cable conductors 31. Upon further motion of the upper housing part 10 in the direction of the arrow A, the gel reservoir or its covering is perforated and the cutting ends of the contact members 11 penetrate into the gel reservoir 24. Simultaneously, i.e., as the upper part 10 moves in the direction of the arrow A, small piston elements 12 and 13 that are formed on the upper part 10 are pressed against the membranes 22 and 23 in the lower part 20. The membranes are then either broken or pushed downward or deformed inwardly by in such a way that pressure is exerted on the gel in the gel reservoir. Then, when the cutting ends of the contact members 11 reach the gel reservoir, the gel is pressed out through the perforations where the cutting ends of the contact members have perforated the gel reservoir, producing immediate sealing of the electrical connections and of the cable.

In an especially advantageous embodiment of the invention, at least one of the pistons, for example the piston 13 of the upper housing part 10, is provided with a channel 14 which, in response to the pressure applied to the membrane and penetration thereof by the piston, transports gel from the gel reservoir 24 through the channel 14 into the upper housing part 10 and also seals the pierced regions of the cable from above.

If desired, silicone may be used as the gel, but self-vulcanizing gels which produce permanent sealing are especially advantageous. When the desired final position of the upper and lower housing parts 10 and 20 after moving toward each other is reached, two clip elements 40 secure the upper housing part 10 on the lower housing part 20 to clamp the cable and form the completed electrical connection, thereby making the connection permanent.

If desired, the connection may be reopened by separation of the clip elements.

Figure 2:
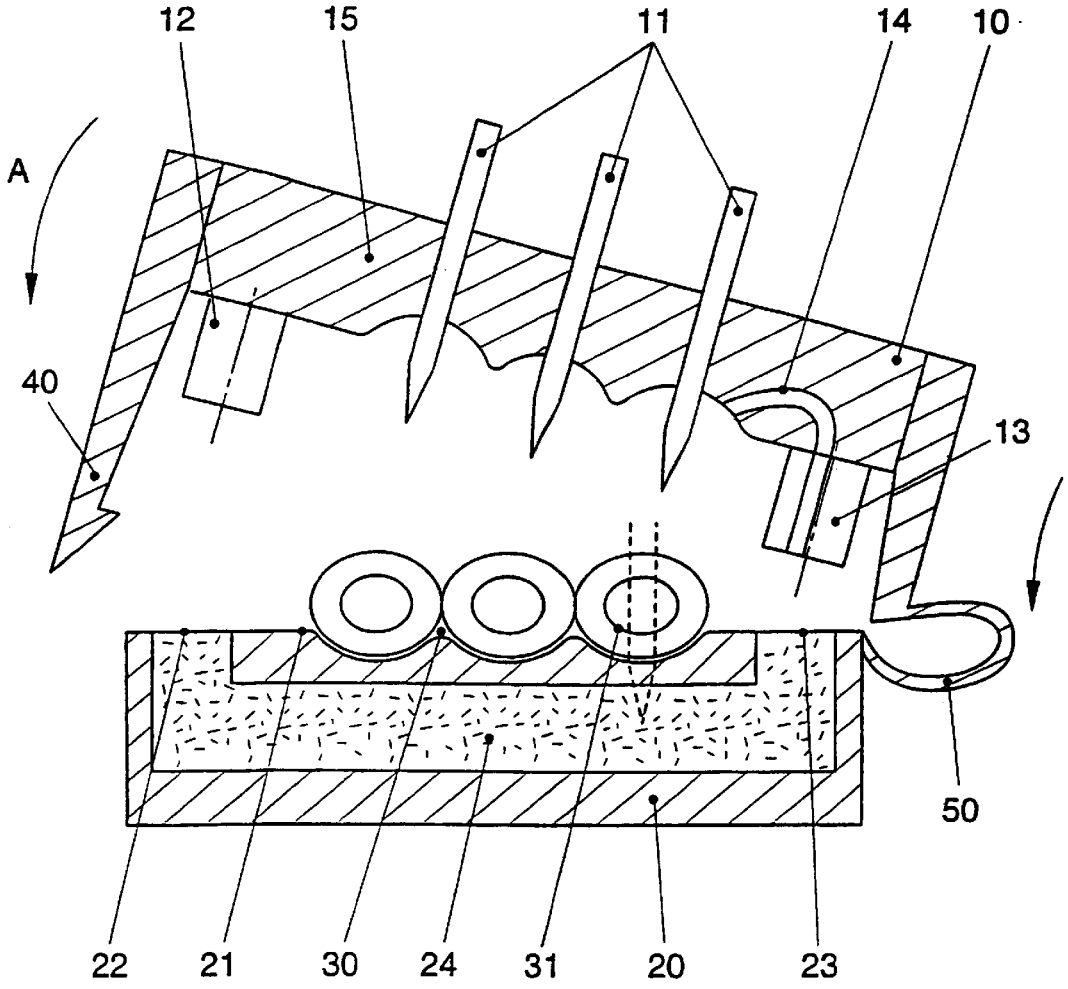
FIG. 2 is a cross-sectional view showing a further representative embodiment according to the invention with the upper and lower housing parts joined by a film hinge.

FIG. 2 shows another embodiment with essentially the same elements, but with a clip element 40 located only on one side instead of on both sides as in FIG. 1, and a film hinge 50 provided on the opposite side so that the upper housing part 10 and the lower housing part 20 are joined together by the hinge. In this embodiment, the motion of the upper housing part 10 and the lower housing part 20 toward each other takes place along an arcuate path as indicated by the arrow A in FIG. 2. Accordingly, the positions of the cutting contacts 11 and the cable or cable conductors must be coordinated with the arcuate path. The pistons 12 and 13 are correspondingly shaped in order to avoid binding and to provide a positive penetration into the gel reservoir 24 while moving along the arcuate path. For this purpose, the pistons may have a slightly curved configuration. The advantage of this embodiment is the one-piece nature of the connection arrangement, which is considerably easier to handle in the manufacture of automobiles.

Suitable shaping of the pistons is not a problem in this embodiment since such parts are produced in an injection molding process and, moreover, only a few suitably shaped injection molds need to be produced for the manufacture of large quantities of connection housings. Therefore, complicated shapes, such as for example curved pistons, do not present a problem.

The two representative embodiments according to the invention as described-above combine two advantages, i.e., establishing an electrical connection with a bus ring circuit without interrupting the circuit, and reliably sealing the insulation cut at the corresponding electrical contact points. Thus, an important aspect of the invention which is achieved in both embodiments is the simultaneous accomplishment of those objectives. The connection arrangement thus can be used advantageously in other fields than automobile manufacture although, for the reasons mentioned above, it exhibits the most advantages in that field.

Although the invention has been described herein with reference to specific embodiments, many modifications and variations therein will readily occur to those skilled in the art. Accordingly, all such variations and modifications are included within the intended scope of the invention.

I claim:

1. An electrical connection arrangement comprising:

a housing having first and second portions with facing surfaces arranged to receive a cable between the surfaces;

at least one contact member mounted in one of the housing portions having a cutting end for piercing cable insulation and establishing electrical contact with a cable conductor;

a gel reservoir in the other housing portion positioned to be penetrated by the cutting end of the contact member after the contact member has established electrical contact with the cable conductor; and means for applying pressure to gel in the gel reservoir to cause gel to flow from the reservoir to the region of the electrical contact between the contact member and the cable conductor.

2. An electrical connection arrangement according to claim 1 wherein the cutting end of the contact member, the facing surfaces shaped to receive a cable and the gel reservoir are located with respect to each other in the first and second housing portions so that, during motion of the first and second portions toward each other, the cutting end of the contact member penetrates the gel reservoir only after it has pierced the cable insulation and made contact with the cable conductor.

3. An electrical connection arrangement according to claim 2 wherein the contact member is located in the first housing portion and the gel reservoir is located in the second housing portion.

4. An electrical connection arrangement according to claim 1 wherein the facing surface of the second housing portion is shaped to conform to the configuration of a cable to be received between the facing surfaces to assure correct positioning with respect to the contact member.

5. An electrical connection arrangement according to claim 1 wherein the first and second housing portions arc movable with respect to each other.

6. An electrical connection arrangement according to claim 5 wherein the first and second housing portions are connected by a hinge member so as to be movable with respect to each other along an arcuate path.

7. An electrical connection arrangement according to claim 1 including a piston on the first housing portion and a corresponding opening leading to the gel reservoir in the second housing portion and a membrane covering the opening, the piston and the corresponding opening being arranged so that the piston engages the membrane during relative motion of the first and second housing parts toward each other to apply pressure to gel in the gel reservoir.

8. An electrical connection arrangement according to claim 7 including at least one channel in the first housing portion arranged to communicate with the gel reservoir so that, after application of pressure by the piston to the gel in the gel reservoir, gel passes through the channel into a region in which the cutting end of the contact member has passed through cable insulation.

9. A method for establishing an electric connection to an electrical conductor in an insulated cable comprising holding an insulated cable having a conductor in position with respect to at least one contact member having a cutting end, moving the contact member toward the cable to cause the cutting end to penetrate the cable insulation and bring the contact member into electrical contact with the cable conductor;

simultaneously applying pressure to gel in a gel reservoir adjacent to the cable; and causing the cutting end of the contact member to perforate the gel reservoir so that gel passes into the region of the electrical contact between the contact member and the cable conductor.

* * * * *